United States Patent [19]

Toth et al.

[11] 4,217,474

[45] Aug. 12, 1980

[54] CAM MEMBER FOR ACTUATING AND/OR RESTRAINING THE MOTION OF A BAIL

[75] Inventors: Maria Toth, Terryville; Frederick A. Reker, Burlington, both of Conn.

[73] Assignee: General Signal Corporation, Stamford, Conn.

[21] Appl. No.: 1,099

[22] Filed: Jan. 5, 1979

Related U.S. Application Data

[63] Continuation of Ser. No. 765,463, Feb. 4, 1977, abandoned.

[51] Int. Cl.[2] ..... H01H 3/20

[52] U.S. Cl. ..... 200/335; 74/569; 200/302; 200/303; 403/121

[58] Field of Search ..... 74/569, 523, 519, 567; 200/330, 331, 332, 333, 334, 335, 339, 293, 153 L, 153 LA, 153 LB, 153 V, 153 HS, 329, 302, 303; 308/202, 208, 215; 292/197, 200, 224, 226, 98, 100, 124, 126; 403/121; D13/32, 37, 40; 174/53, 58, 46

[56] References Cited

U.S. PATENT DOCUMENTS

| | | | |
|---|---|---|---|
| 1,924,351 | 8/1933 | Doddridge | 200/330 |
| 2,290,516 | 7/1942 | Willmann | 200/330 X |
| 2,639,356 | 5/1953 | Savage | 200/333 X |
| 3,075,396 | 1/1963 | Smith | 200/330 X |
| 3,217,112 | 11/1965 | Campbell et al. | 200/339 X |
| 3,752,947 | 8/1973 | Strobel | 200/332 |
| 3,816,686 | 6/1974 | Budd et al. | 200/330 |
| 3,946,186 | 3/1976 | Howie, Jr. | 200/330 X |
| 4,000,383 | 12/1976 | Lockard | 200/339 X |
| 4,031,340 | 6/1977 | Pastorel | 200/302 X |

*Primary Examiner*—C. J. Husar
*Assistant Examiner*—Moshe I. Cohen
*Attorney, Agent, or Firm*—Milton E. Kleinman; George W. Killian; Harold S. Wynn

[57] ABSTRACT

A simplified linkage and cam member having first and second cam surfaces for interacting with a bail to drive said bail between first and second limits is provided. The cam surfaces restrict the movement of the bail when the bail is at either limit. However, when the bail is intermediate of the limits, the relationship of the effective portions of the cam surfaces allow increased bail movement for a given position of the cam member and associated cam surfaces. The structure is particularly well adapted for actuating a bail from a first to a second position wherein forces other than those applied by the cam also act on the bail; and at a critical bail position, the other forces take control and urge continued motion of the bail independent of the cam member. In such structure, the bail is first urged to move by the first cam surface, and at a critical point in its movement, it jumps from the first cam surface to the second cam surface and, for at least part of the remaining motion of the bail, the second cam surface serves to restrain the bail motion. The cam surfaces may be symmetrical in design and provide effective forces on the bail at both the start and end of the motion. The bail may, for example, constitute the actuating arm of a circuit breaker which is within an enclosure and actuated by an external arm coupled by the linkage and cam member.

6 Claims, 6 Drawing Figures

CAM MEMBER FOR ACTUATING AND/OR RESTRAINING THE MOTION OF A BAIL

This is a continuation of application Ser. No. 765,463 filed Feb. 4, 1977 now abandoned.

BACKGROUND OF THE INVENTION

A wide variety of mechanisms have been designed and developed for translating motion from one element to another. The present mechanism relates to a structure for actuating a bail between first and second positions usually along a portion of an arc which may comprise some fifty or sixty degrees of arc to eighty or one hundred degrees. Such mechanisms may appear in varied devices, such as camera shutters, typewriter mechanisms, display devices, factory machines, and extension levers for actuating recessed light switches or circuit breakers.

The invention is specifically directed to the reciprocal actuation of a bail in response to the actuation of a lever. In some types of linkages, the bail may have to be driven from a first position to a second position. In other types of systems, the bail may be acted upon by auxiliary forces, so that once the bail is urged from an initial position to a critical position, the auxiliary forces urge the bail towards its destination independent of the force of the actuating linkage. In such systems, it is sometimes desirable to allow at least some free travel of the bail once it has reached the critical point. In some structures, it is desirable to have the actuating cam in intimate contact with the bail when the bail is at either at rest position so that tactile feedback can be provided to indicate the bail position. Phrased differently, it is sometimes desirable to have no "lost motion" of the actuating lever when the bail is in an at rest position. However, as mentioned above, there are mechanisms wherein it is desirable to allow the bail to have at least some free motion independent of the actuating cam during at least part of the time that the bail is intermediate of its at rest positions.

The structure disclosed herein is directed to mechanisms of the class which require no lost motion of the actuating lever when the bail is at its at rest positions and which requires at least some free motion of the bail when it is intermediate of its at rest positions. However, the invention could readily be adapted to an inverse application wherein at least some lost motion of the actuating lever is required when the bail is at its at rest positions and which requires reduced free motion of the bail when it is intermediate of its at rest positions.

An example of a practical structure having the first requirements is that of a circuit breaker within an enclosure and actuated by an auxiliary lever extending through a wall of the enclosure. When the circuit breaker is at either at rest position, the auxiliary lever should have minimum free motion so that, by tactile feedback, one manipulating the auxiliary lever could sense the position of the circuit breaker. When the circuit breaker is being moved from its closed circuit to its open circuit position, it is desirable for the circuit breaker arm to be allowed at least some free motion during the time the contacts are actually being opened.

A variety of linkages have been developed for providing features similar to those described. Such prior art linkages have frequently employed a plurality of parts including some or all of the following: auxiliary springs, auxiliary lost motion structures, knuckles, separate on and off levers, and a variety of other structures.

SUMMARY OF THE INVENTION

The present invention provides a simple member having first and second cam surfaces, one of which initiates bail actuation in one direction and the other of which initiates bail actuation in the other direction. The geometry of the actuating lever, the bail, and the cam surfaces are arranged and constructed to provide a structure wherein there is minimum clearance between the bail and the first and second cam surfaces when the bail is in either at rest position. At least part of the effective portion of both cam surfaces diverge from each other. As the bail and the actuating lever pivot about their respective centers, the bail slides, or rolls, on the active cam surface. Thus the cam moves to a point wherein the bail is in contact with only one cam surface and at least some free motion of the bail is possible before contacting the other cam surface if the actuating lever is held stationary and the bail moved by auxiliary forces.

In one embodiment, the first and second cam surfaces are symmetrical about a center line of the cam member. The angle of the cam surface with the center line of the cam member, while not critical, must be within certain limits. For the structure illustrated in FIGS. 1 through 4, the bail is located between the pivot point of the bail and the pivot point of the cam member. With this structure, a relatively large angle between the cam surface and the center line of the cam member will provide a high initial force to initiate bail actuation. However, a small angle is required to provide a high effective force to urge the bail to an at rest position. Accordingly, the angle of the cam surface with respect to the center line of the cam member must be a compromise angle which provides adequate effective forces and which permits sufficient free motion of the bail. For other relationships of pivot points and members, the cam angle may vary.

It is an object of this invention to provide a new and improved structure for actuating a bail between first and second at rest positions.

It is another object of this invention to provide a bail actuating mechanism wherein there is minimum lost motion of the actuating mechanism when the bail is in either at rest position.

It is another object of this invention to provide a bail actuating mechanism which provides for at least some free motion of the bail when it is intermediate of its at rest positions.

It is another object of the invention to provide a pivoted bail actuating mechanism having two cam surfaces, both of which are in contact, or nearly so, with the bail when the bail is in either at rest position.

It is a further object of the invention to provide a pivoted double cam actuating mechanism for actuating a pivoted bail which provides for at least some free motion of the bail when it is intermediate of its at rest positions and which permits minimum free motion of the bail when it is at either at rest position.

It is another object of the invention to provide cam surfaces for actuating a pivoted bail as afore described and which provides adequate effective force for initiating bail motion and for completing bail motion.

BRIEF DESCRIPTION OF THE DRAWING

A preferred embodiment of the invention will be described, together with the drawing figures, in which like elements are given like numbers except that in FIG. 6, which illustrates an alternate structure, the elements are numbered so that the last two digits correspond with the last two digits of the elements of the other figures which most nearly correspond, and in which.

DESCRIPTION OF THE PREFERRED EMBODIMENT

Figure 1:
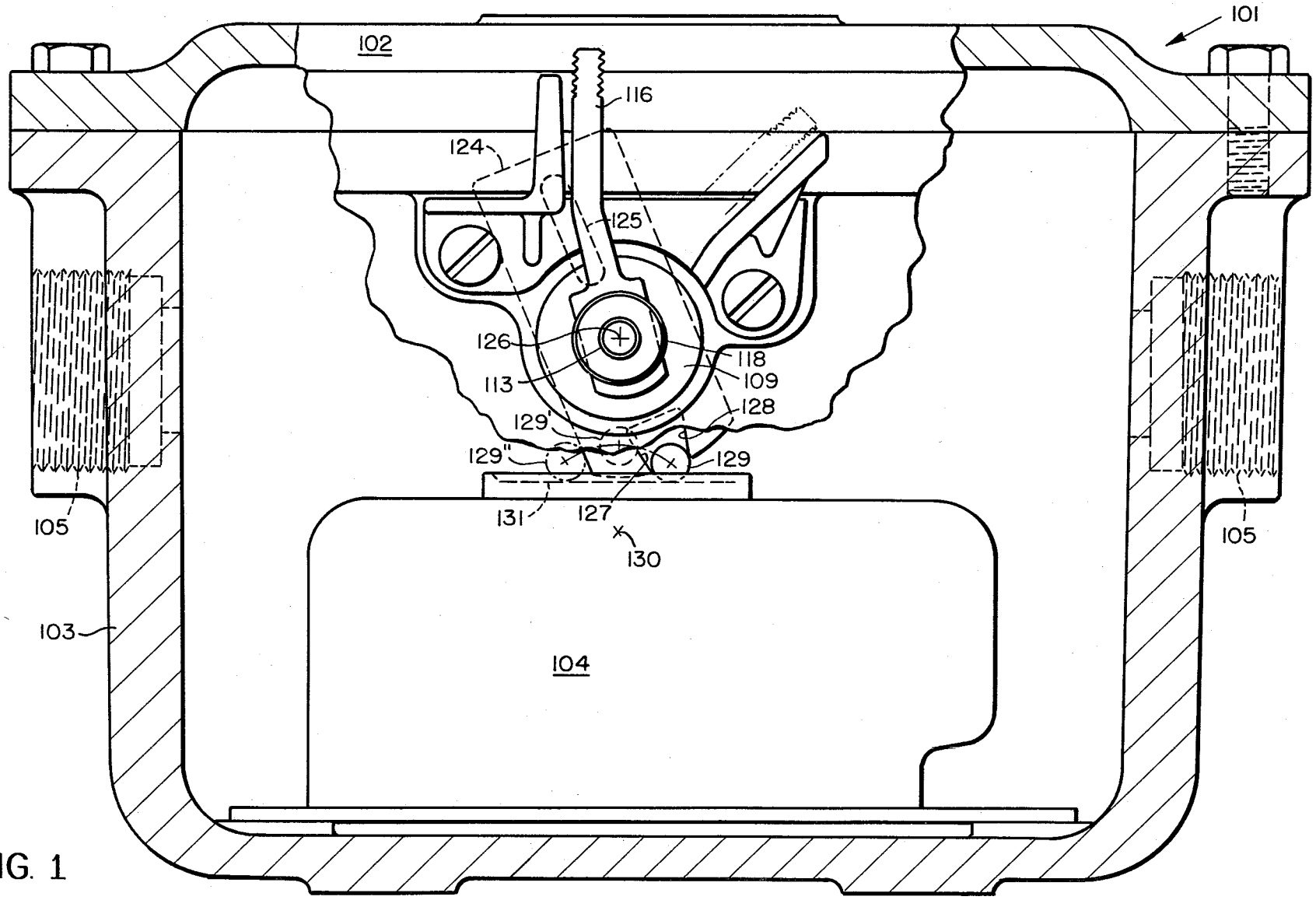
FIG. 1 constitutes a front view of a structure which embodies the invention, partly in cross section and partly cut away.
Figure 2:
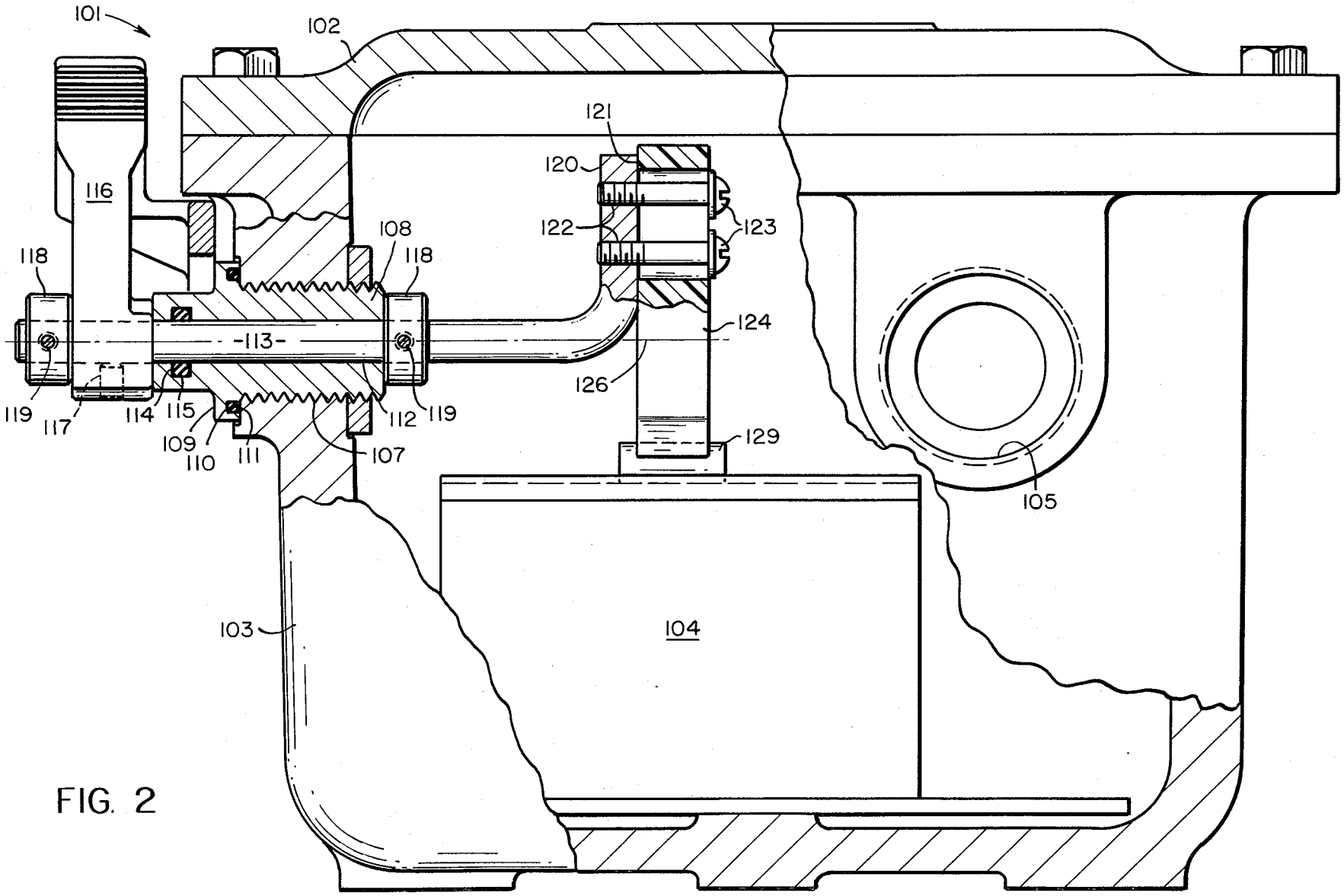
FIG. 2 is a side view of the same structure with parts in cross section and part cut away.

Considering now more specifically FIGS. 1 and 2, taken together, there will be seen therein a structure in which the invention may be incorporated. More specifically, the invention comprises a linkage for actuating a bail in a setting wherein the bail constitutes the actuating arm of a circuit breaker enclosed within an explosion proof container and having a linkage for actuating the circuit breaker by manipulating an external lever. Such a structure finds particular utility where it is necessary to provide a circuit breaker in an atmosphere which might include explosive gases. In such situations, the circuit breaker is enclosed in an explosion proof box so that an explosion cannot be initiated from a spark created when the circuit breaker opens. In order to permit one to feel the external lever and determine the position of the circuit breaker arm, it is desirable to have minimum lost motion of the linkage connecting the external lever and the circuit breaker arm. That is, if the circuit breaker is in either its open or closed position, there should be minimum possible motion of the external lever without providing a feeling that it is contacting the circuit breaker arm and moving it. However, when one is using the external lever to open the circuit breaker, it is desirable to allow free motion of the circuit breaker arm during at least the time that the contacts are being opened so that the contacts may separate quickly and quench any spark. Accordingly, the linkage connecting the external lever and the circuit breaker arm is designed to provide minimum lost motion of the external lever when the circuit breaker is at either at rest position, but to allow at least some free motion of the circuit breaker arm after the external lever and associated linkage has moved the circuit breaker arm from its at rest position.

The explosion proof box containing the circuit breaker is indicated generally as 101. The box 101 includes a cover 102 and the container section 103. Contained within the box 101 is the circuit breaker 104. Wiring may be brought into and/or out of the box 101 through openings 105 in which a fitting (not shown) may be placed to seal the wiring in the opening 105 and prevent an exchange of atmosphere between the interior and exterior of the box 101. Another opening 107 is provided through which a mechanism couples to the linkage which actuates the circuit breaker 104 and about which more will be said below. Threaded into the opening 107 is a plug 108 having a flange 109 with a circular groove 110 accommodating an 0-ring 111 which contacts a portion of the container 103 to provide a seal. The plug 108 includes a hole 112 in which a shaft 113 is journalled. Another groove 114 and 0-ring 115 seal the shaft 113 to prevent an exchange of atmosphere between the interior and exterior of the box 101. Secured to the shaft 113 is an operating arm 116 which may be secured to the shaft 113 by any convenient means, such as a key or set screw 117. To prevent end play of the shaft 113, locking collars 118 are secured to the shaft 113 by set screws 119.

The shaft 113 includes an upturned end 120 having a flattened surface 121 and two tapped holes 122. Secured to the flat surface 121, by means of screws 123 into the tapped holes 122, is a cam member 124, shown in more detail in FIG. 5.

Figure 5:
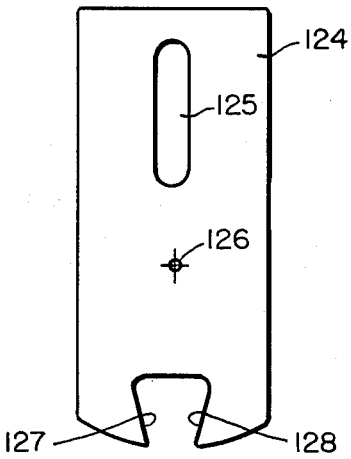
FIG. 5 is a view of the cam member.

As may be seen in FIG. 5, the cam 124 includes a slot 125 through which the screws 123 pass to secure the cam 124 to the upturned end 120 of the shaft 113. The slot 125 allows some vertical adjustment of the cam 124 with respect to the upturned end 120 and/or the circuit breaker 104. As may be readily envisioned, the pivoting of arm 116 will rotate shaft 113 and cause the upturned end 120 and the attached cam 124 to pivot between two limits about the center line 126 of the shaft 113. The cam member 124 includes two cam surfaces 127 and 128.

By way of review of salient features, the cam member 124 pivots about pivot point 126 in response to actuation of the arm 116, and the slot 125 provides for adjustment of the cam member to modify slightly the location of the cam member 124 relative to the center of rotation 126.

Figure 3:
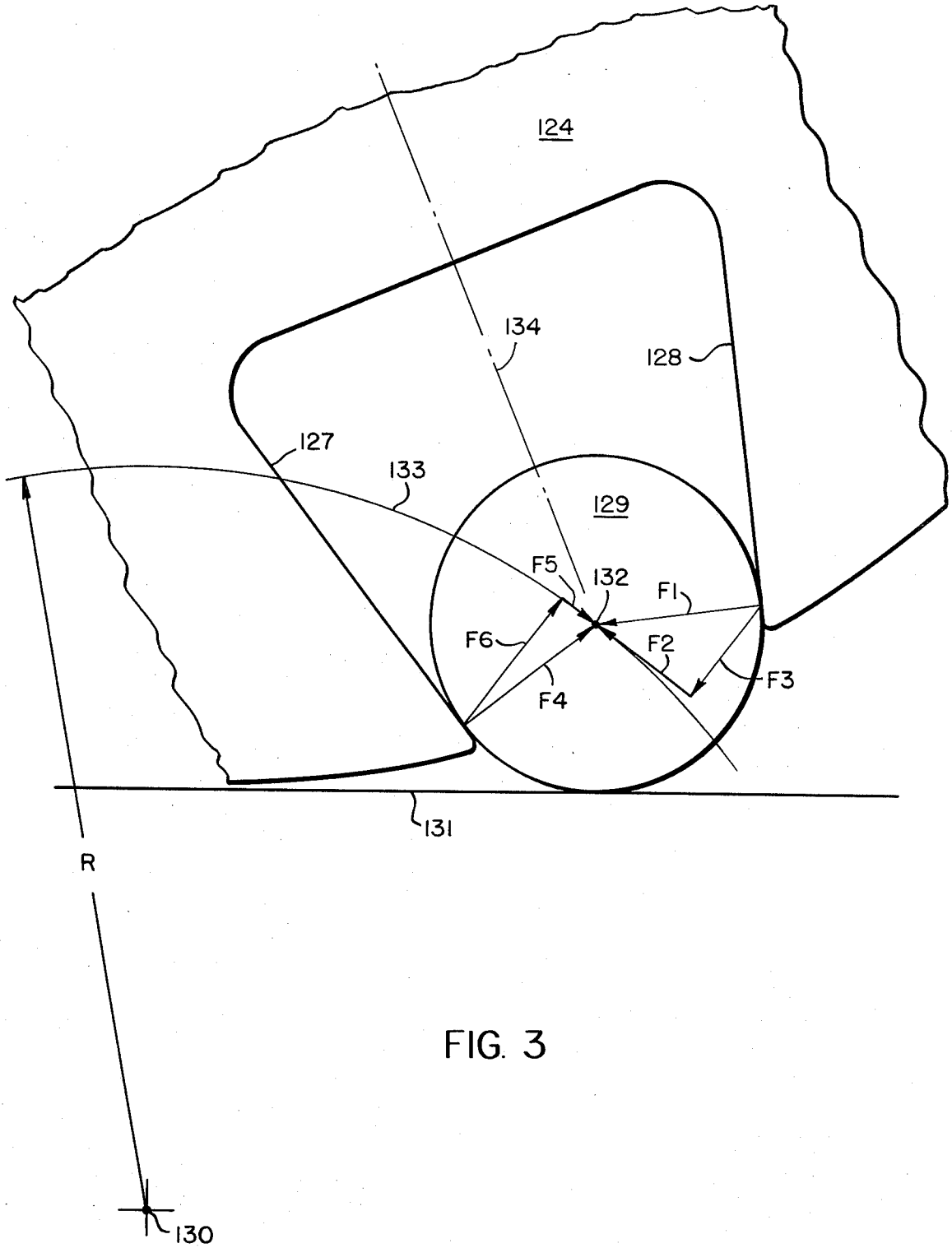
FIG. 3 comprises an enlarged view illustrating the vector forces available for the initial movement and the final return of the bail member.

Considering now more specifically FIG. 1, there will be seen a view of the cam member 124 and the circuit breaker 104, including the circuit breaker actuating arm 129 which pivots about a center 130 from an on position, as indicated by the arm 129, to an intermediate position, as indicated by 129', and an off position, as indicated by 129''. A plane indicating the limit of the downward motion of the circuit breaker arm 129 is indicated at 131. A greatly enlarged view of a portion of the cam member 124 and the circuit breaker arm 129 is illustrated in FIG. 3, and FIG. 5 is a view of the cam member 124 as used in the structure of FIGS. 1 and 2.

The circuit breaker arm or bail 129 is illustrated as having a circular cross section, and in many conventional and commercial circuit breakers such is the case. In fact, it is not unusual for a circuit breaker arm to include a rotating member on the arm. However, the present application is not limited to circuit breakers having this configuration and many other configurations could be accommodated with the same cam or perhaps a slightly modified cam. For the present discussion, it will be assumed that the circuit breaker 104 is in the on position when the arm 129 is to the right. That is, when the arm 129 is at the right, the contacts in the circuit breaker 104 are closed and current may pass through the wires connected to the circuit breaker 104. When the arm 129 is moved to the left, the circuit breaker contacts are open and no current may pass through the wires connected to the circuit breaker 104. Those familiar with circuit breaker actuation will recall that when the arm is moved from the on to the off position, a relatively high initial actuating force is required, but that after the arm is moved to a critical point, usually less than half the total travel, the arm snaps to the left under control of internal forces. The electrical contacts are opened during the initial part of the free motion of the circuit breaker arm and it is highly desirable to allow such free motion to allow the contacts to open rapidly and quench any sparks therebetween. It will be seen that the structure disclosed provides for this free flight of the actuating arm 129 when it is intermediate of its two at rest positions. However, in order to get good tactile feedback and permit an operator to determine the position of the circuit breaker by feeling the resistance to motion of the external arm 116, it is necessary to have the cam member 124 in contact with the arm 129 when it is at either of its at rest positions. Returning now more specifically to FIG. 3, there will be seen an enlarged view of the cam surfaces 127 and 128 of the cam member 124 and the arm 129. The arm 129 is illustrated at the right with the circuit breaker in the on position. The line 131 represents the plane that limits the downward motion of the arm 129 and determines the left and right at rest positions of the arm 129. Point 132 represents the center of the arm 129, and 130 is the center of rotation of the arm 129 and, therefore, the arc 133 represents the locus of the point 132 as the arm 129 is moved from one position to another. If the shaft 113 is rotated by actuation of the arm 116, the cam member 124 will be pivoted clockwise about center line 126 of the shaft 113. This will cause cam surface 128 to bear against the arm 129 and apply a force against the arm 129. The cam surface 128 is, or course, tangent to the arm 129 and the force acts at the point of tangency and passes through the center 132. The applicable force is illustrated by vector F1. Since the arm 129 can only move along the arc 133, that portion of the force F1, which is effective to move the arm 129 along the arc 133, is the vector component which passes through point 132 and is tangent to the arc 133. This vector force is illustrated as vector F2. Vector F3 is the vector component which combines with F2 to provide the resultant vector F1. If line 134 represents the center line of the cam member 124, it will be evident that if the angle between cam face 128 and center line 134 were increased, the vector component F2 would become larger; and with a sufficiently large angle, vector F2 would approach F1 in value and F3 would diminish to zero. The reason for not increasing the angle between cam face 128 and the center line 134 to provide a maximum initial effective vector force will become more apparent as the description proceeds.

Consider now the forces applied to the arm 129 at the final instant that the arm 129 is restored from the open position to the closed position. Under these conditions, the cam surface 127 will be acting on the arm 129 to restore it to its right hand at rest position. The cam surface 127 is, of course, tangent to the arm 129 and the force applied is at right angles to the cam face 127 at the point of tangency and acts towards the point 132. This vector is illustrated as force F4. The portion of the vector F4 which is effective to urge the arm 129 towards its right hand position is the vector component which is tangent to the locus 133 at the point 132. This vector component is illustrated as F5. The remaining vector component is illustrated as F6. It will be evident that if the angle between the cam surface 127 and the center line 134 was reduced or even made such that the intersection of the line 127 representing the cam surface and the center line 134 would intersect at a point above 132, the vector force F5 would be increased.

If the arm 129 is now envisioned as at the left in its off position, it will be seen that the cam surfce 127 must provide the force for initiating the movement of the arm 129 from the left to the right, and that the available force will correspond to the vectors F1, F2 and F3. Thus it may be seen that the cam surfaces 127 and 128 are each required to provide both an initial and final force to move the arm 129, and that the cam face orientation which provides a maximum initiating force would not provide a suitable final force, and that a cam orientation which would provide a maximum final force would not provide a satisfactory initial force. Accordingly, a compromise cam face orientation must be employed. Although the described application for operating a circuit breaker does not require a symmetrical cam, it is considered desirable to provide a symmetrical cam in order to eliminate the possibility of improper assembly. The illustrated application does not require a symmetrical cam because the cam surface 128 is not required to provide any substantial force to move the arm 129 to its final left hand at rest position. That is, as previously mentioned, internal forces within the circuit breaker 104 urge the arm 129 towards its left hand position, once the arm 129 has advanced to a certain critical point along the locus 133.

Another factor which may effect cam angle design is the strength of the cam member. If the angle is too large, the structure may be weakened, or the cam member may be required to have greater overall dimensions.

It will be observed that with the arm 129 in its at rest position, as illustrated in FIG. 3, that cam surfaces 127 and 128 are both in contact with the arm 129. Accordingly, any attempt to wiggle the arm 116 will immediately provide a tactile feedback as one or the other of the cam surfaces 127 or 128 will contact the arm 129 and motion will be resisted. That is, the arm 116 has no lost motion. The same relationship exists when the arm 129 is as its left hand position. If the cam member 124 is moved slightly by taking advantage of the adjustment provided by slot 125 and screws 123, the magnitude of the free motion of the arm 129 may be adjusted at the at rest positions and the intermediate positions.

Figure 4:
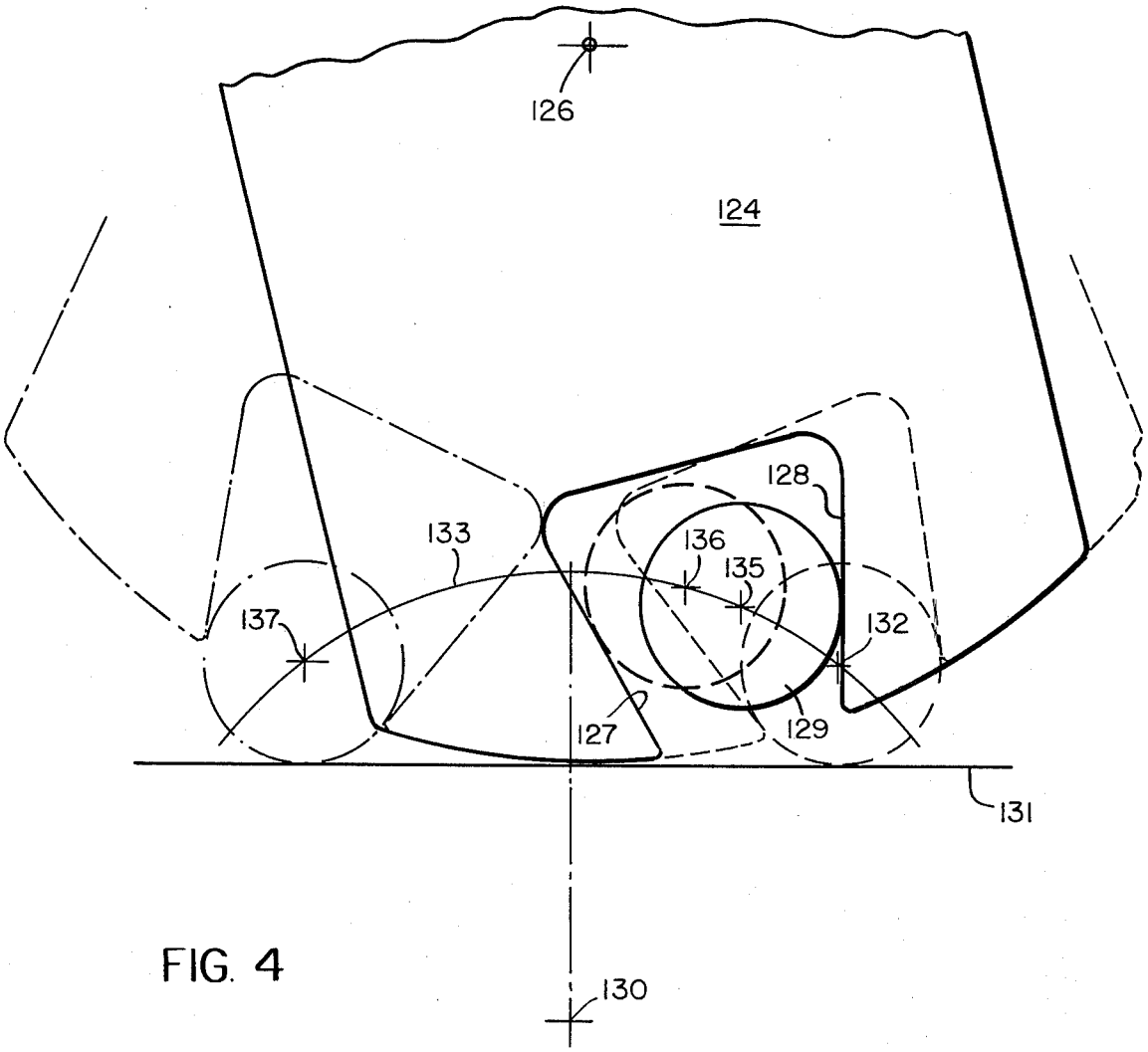
FIG. 4 is an enlarged view showing the relationship between the bail member and the cam member with the bail member in a variety of positions.

Attention should now be directed more specifically to FIG. 4 which constitutes an enlarged view of a portion of the cam member 124 (but not enlarged as much as shown in FIG. 3) and with the cam member 124 illustrated in three positions; a first position in solid lines; and a second and third positions in different styles of dashed lines. The arm 129 is illustrated in its left and right at rest positions and two intermediate positions. The center of the arm 129, when it is in its right hand at rest position, is illustrated by point 132. When the cam member 124 has been pivoted clockwise about the center of rotation 126 to the position shown by solid lines in FIG. 4, the arm 129 will have its center 132 moved along the locus 133 to point 135 by the forces applied by cam surface 128. It will be observed that when the arm 129 has its center point 135, no portion of the arm 129 is in contact with cam surface 127. Accordingly, if position 135 represents the tripping position of the circuit breaker 104, the arm 129 may move, by forces applied internally of the circuit breaker 104, and the center 135 will jump to position 136. That is, without any further movement of the cam member 124, the arm 129 may move its center from position 135 to 136 or, phrased differently, while the arm 129 is at a point intermediate of its two at rest positions, there is room for free travel of the arm 129. For the remainder of the travel of the arm 129, from point 136 to its left hand at rest position point 137, the cam face 127 will actually be restraining the motion of the arm 129. However, as illustrated by the dashed outline of the cam faces 127 and 128, both such faces are in contact with the arm 129 while it is at its left hand at rest position.

Figure 6:
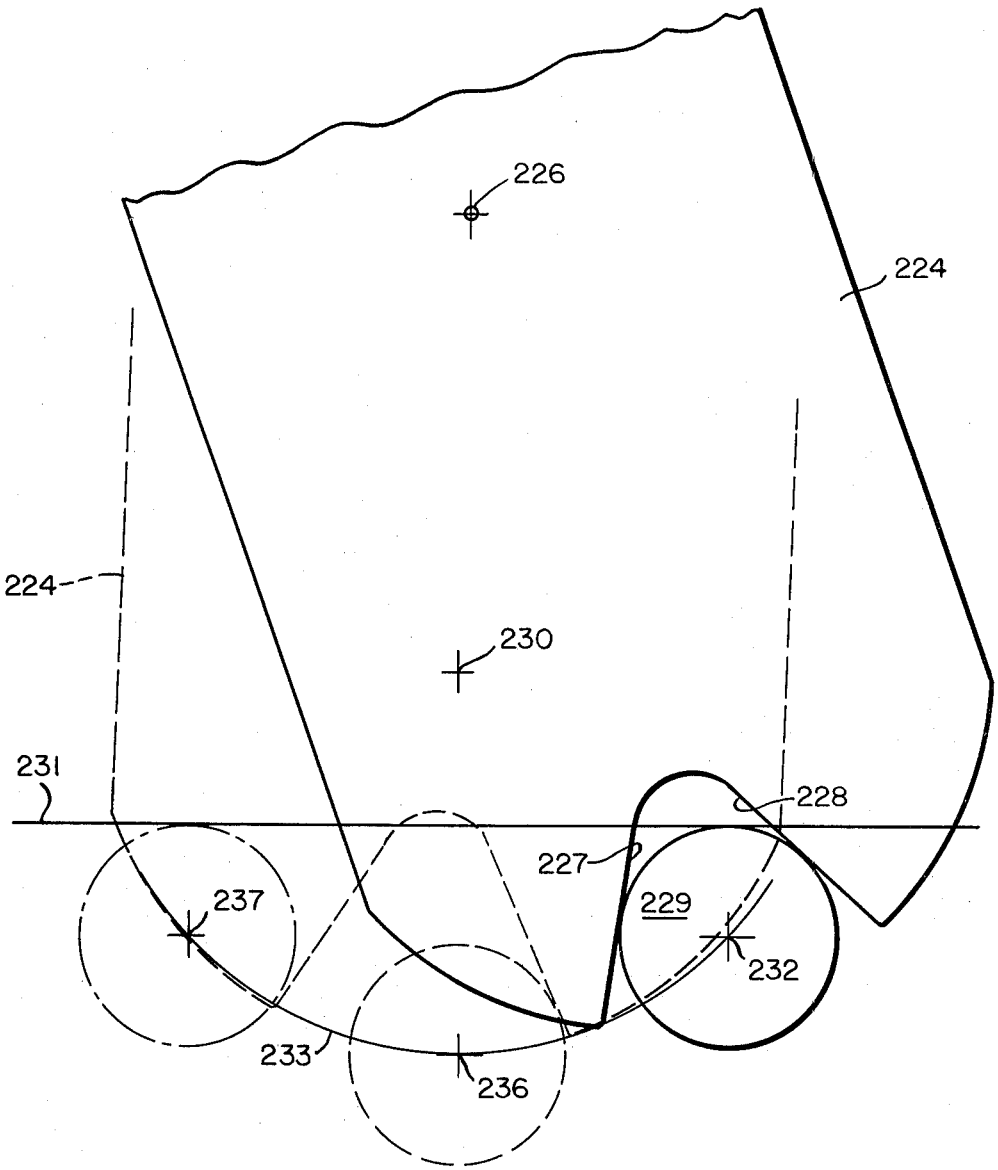
FIG. 6 illustrates an alternate structure with the pivot points of the bail and the cam member on the same side as the cam.

There has been shown a linkage for actuating a bail, such as a circuit breaker arm, wherein there is negligible lost motion of the linkage when the bail is in its at rest position and which provides for a least some free travel of the bail while it is at an intermediate position. In the examples illustrated thus far, the bail is intermediate of the pivot point of the cam member and the bail. This particular relationship may not always be available and it may be necessary to provide a similar structure wherein the pivot points of the cam member and the bail are both on the same side of the bail. Such a situation is illustrated in FIG. 6. Most of the elements of FIG. 6 correspond very closely with elements in the other figures and, therefore, the elements of FIG. 6 have been given identifying numbers wherein the last two digits correspond to the last two digits of the most closely related elements in the other figures. In FIG. 6, the cam member 224 is pivoted about point 226 and the cam faces 227 and 228 act on the bail 229. As may be seen, the locus of the center of the bail 229, as it moves from one rest position to the other, is along arc 233 which has its center at 230. It will be seen that the bail cannot move from either at rest position because of the constraining influence of the cam faces 227 and 228. However, when the bail 229 is at an intermediate position, for example, as shown with its center at point 236, there is room for free motion of the bail 229 between the cam faces 227 and 228.

In some structures it may be desirable to move a bail along a straight line instead of an arc. This may be pictured as a structure similar to that shown in FIG. 4 wherein the radius of the locus of the center of the bail 129 is of infinite radius. In such case, the cam member would be similar to that shown in FIG. 4.

A relationship may also exist wherein the bail is pivoted, but the cam member has a straight line motion which may be envisioned as pivoting from a center of infinite radius. In such case, cam members similar to those shown may be used.

Situations may also arise wherein it is desired to permit free travel of the bail while in its at rest position, but to have more restricted free motion of the bail while it is at an intermediate position. These objectives may be met by using the cam member 224 of FIG. 6 with the structure of FIG. 1, or the cam member 124 of FIG. 5 with the structure of FIG. 6.

In summary, there has been shown a linkage for actuating a bail which allows no free motion of the bail when it is in its at rest position, but which allows some free motion of the bail when it is in an intermediate position. The bail may move on either a straight line or arc course and the cam member may move on either a straight line or arc course as long as at least one or the other is moving along an arc.

While there has been shown and described what is considered at the present to be a preferred embodiment of the invention, modifications thereto will readily occur to those skilled in the related arts. It is believed that no further analysis or description is required and that the foregoing so fully reveals the gist of the present invention that those skilled in the applicable arts can adapt it to meet the exigencies of their specific requirements. It is not desired, therefore, that the invention be limited to the embodiments shown and described, and it is intended to cover in the appended claims all such modifications as fall within the true spirit and scope of the invention

What is claimed is:

1. A bail actuating member for initiating movement of a bail along a first predetermined arcuate path in a first plane and between first and second limits and comprising in combination:

(a) a cam member supported for arcuate motion in said first plane and having first and second cam surfaces with each cam surface having a first portion which is proximate to the bail when the bail is at either of its first and second limits whereby neither said cam member nor the bail can move when the bail is situated at its first or second limit without simultaneous motion of the other;

(b) said first and second cam surfaces each having second portions which serve to urge and restrict the motion of the bail after it is moved from said first limit and towards said second limit, or after the bail is moved from said second limit and towards said first limit, respectively, in response to motion of said cam member; and wherein (c) said second portions of said cam surfaces are not both proximate to the bail when the bail is intermediate of said first and second limits whereby the bail is free to move through at least a portion of its travel between said first and second limits without synchronous motion of said cam member.

2. The combination as set forth in claim 1, wherein the bail constitutes the actuating arm of an electrical device within an enclosure and said cam member is coupled to actuating means external of said enclosure.

3. The combination as set forth in claim 1, wherein said first portion of said first cam surface initiates movement of the bail and said second portion of said second cam surface restrains movement of the bail during at least part of the motion of the bail from said first to said second limits.

4. The combination as set forth in claim 1, wherein said cam member and the bail pivot about first and second centers, respectively, during their respective motion.

5. The combination as set forth in claim 4, wherein said first and second centers are on opposite sides of the bail.

6. The combination as set forth in claim 4, wherein said first and second centers are on the same side of the bail.

* * * * *